US009863303B2

(12) United States Patent
Hosokawa et al.

(10) Patent No.: US 9,863,303 B2
(45) Date of Patent: Jan. 9, 2018

(54) COOLING WATER CONTROL APPARATUS

(71) Applicant: TOYOTA JIDOSHA KABUSHIKI KAISHA, Toyota-shi, Aichi-ken (JP)

(72) Inventors: Yohei Hosokawa, Susono (JP); Takashi Amano, Susono (JP); Satoru Ito, Susono (JP); Kojiro Hayakawa, Shizuoka-ken (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 0 days.

(21) Appl. No.: 14/787,502

(22) PCT Filed: Apr. 30, 2013

(86) PCT No.: PCT/JP2013/062619

§ 371 (c)(1),
(2) Date: Oct. 28, 2015

(87) PCT Pub. No.: WO2014/178112

PCT Pub. Date: Nov. 6, 2014

(65) Prior Publication Data

US 2016/0061091 A1 Mar. 3, 2016

(51) Int. Cl.
*F01P 3/20* (2006.01)
*F01P 11/14* (2006.01)
(Continued)

(52) U.S. Cl.
CPC ..... *F01P 7/14* (2013.01); *F01P 3/20* (2013.01); *F01P 7/164* (2013.01); *F01P 11/14* (2013.01);
(Continued)

(58) Field of Classification Search
CPC .... F01P 7/14; F01P 7/164; F01P 7/165; F01P 3/20; F01P 11/14; F01P 2037/02;
(Continued)

(56) References Cited

U.S. PATENT DOCUMENTS 2,408,269 A 9/1946 Peterson
6,321,697 B1 11/2001 Matsuda et al.
(Continued)

FOREIGN PATENT DOCUMENTS

CN 2065674 U 11/1990
CN 1277928 A 12/2000
(Continued)

OTHER PUBLICATIONS

Machine translation of JP2009180103A, Morita, Aug. 13, 2009, obtained from https://worldwide.espacenet.com, pp. 1-32.*
(Continued)

*Primary Examiner* — Grant Moubry
(74) *Attorney, Agent, or Firm* — Andrews Kurth Kenyon LLP

(57) ABSTRACT

A cooling water control apparatus controls a cooling apparatus having first pipe which circulates cooling water through an engine; second pipe which circulates cooling water not through the engine; a switching valve whose state is changed between opened and closed states; and a supplying mechanism which supplies cooling water, and has a determining device which determines whether there is failure of the switching valve based on difference between first temperature of cooling water in first pipe and second temperature of cooling water in second pipe after the command for changing the state of the switching valve from closed state to opened state is outputted; and a controlling device which controls the supplying mechanism to supply cooling water even after the engine stops, when the engine stops while the determining device determines whether there is failure of the switching valve.

5 Claims, 8 Drawing Sheets

(51) Int. Cl.

| | |
|---|---|
| ***F01P 7/14*** | (2006.01) |
| ***F01P 7/16*** | (2006.01) |
| *F02G 5/02* | (2006.01) |

(52) U.S. Cl.
CPC ..... *F01P 2007/146* (2013.01); *F01P 2025/32* (2013.01); *F01P 2025/52* (2013.01); *F01P 2037/02* (2013.01); *F01P 2050/24* (2013.01); *F01P 2060/00* (2013.01); *F01P 2060/08* (2013.01); *F01P 2060/16* (2013.01); *F02G 5/02* (2013.01)

(58) Field of Classification Search
CPC ..... F01P 2025/32; F01P 2025/52; F01P 2050/24; F01P 2060/00; F01P 2060/08; F01P 2060/16; F01P 2007/146; F02G 5/02
See application file for complete search history.

(56) References Cited

U.S. PATENT DOCUMENTS

| | | | | |
|---|---|---|---|---|
| 6,615,647 | B2 * | 9/2003 | Niki | F01P 11/16 73/114.68 |
| 8,573,163 | B2 * | 11/2013 | Kinomura | F01P 7/165 123/41.02 |
| 9,261,012 | B2 * | 2/2016 | Saitoh | F01P 7/165 |
| 2007/0290056 | A1 * | 12/2007 | Fishman | F01P 7/16 236/34.5 |
| 2009/0038593 | A1 * | 2/2009 | Blumendeller | F02M 26/25 123/568.12 |
| 2012/0137992 | A1 | 6/2012 | Kinomuka et al. | |
| 2016/0102601 | A1 * | 4/2016 | Hosokawa | F01P 7/14 123/41.08 |

FOREIGN PATENT DOCUMENTS

| | | | |
|---|---|---|---|
| CN | 102575569 | A | 7/2012 |
| EP | 2 487 346 | A1 | 8/2012 |
| JP | 2004232519 | A | 8/2004 |
| JP | 2007-056722 | A | 3/2007 |
| JP | 2008-215183 | A | 9/2008 |
| JP | 2009-180103 | A | 8/2009 |
| JP | 2011-102545 | A | 5/2011 |
| JP | 4883225 | B2 | 2/2012 |
| WO | 2011/042942 | A1 | 4/2011 |

OTHER PUBLICATIONS

US Patent and Trademark Office, Non-Final Office Action issued in U.S. Appl. No. 14/787,363, dated Jun. 14, 2017, 7 pages.
U.S. Patent and Trademark Office, Notice of Allowance in U.S. Appl. No. 14/787,363 dated Sep. 13, 2017, 7 pages.

* cited by examiner

[FIG. 1]
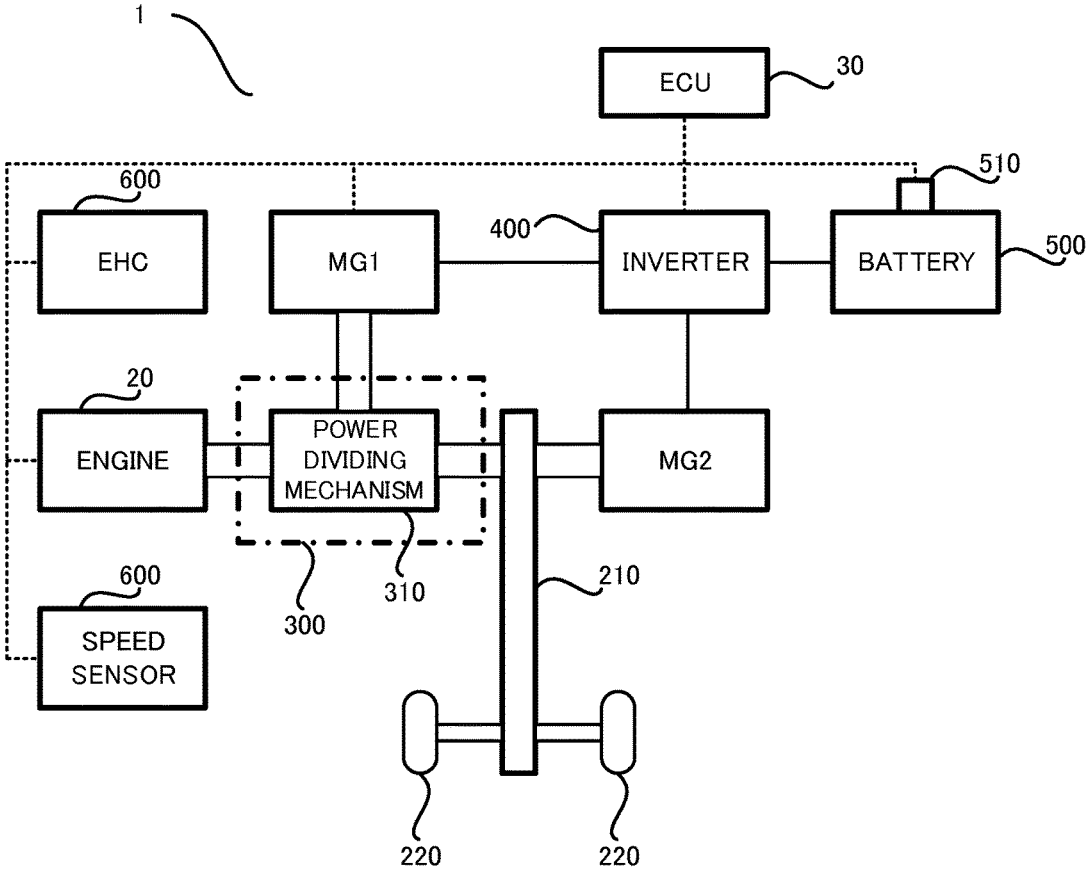

[FIG. 2]
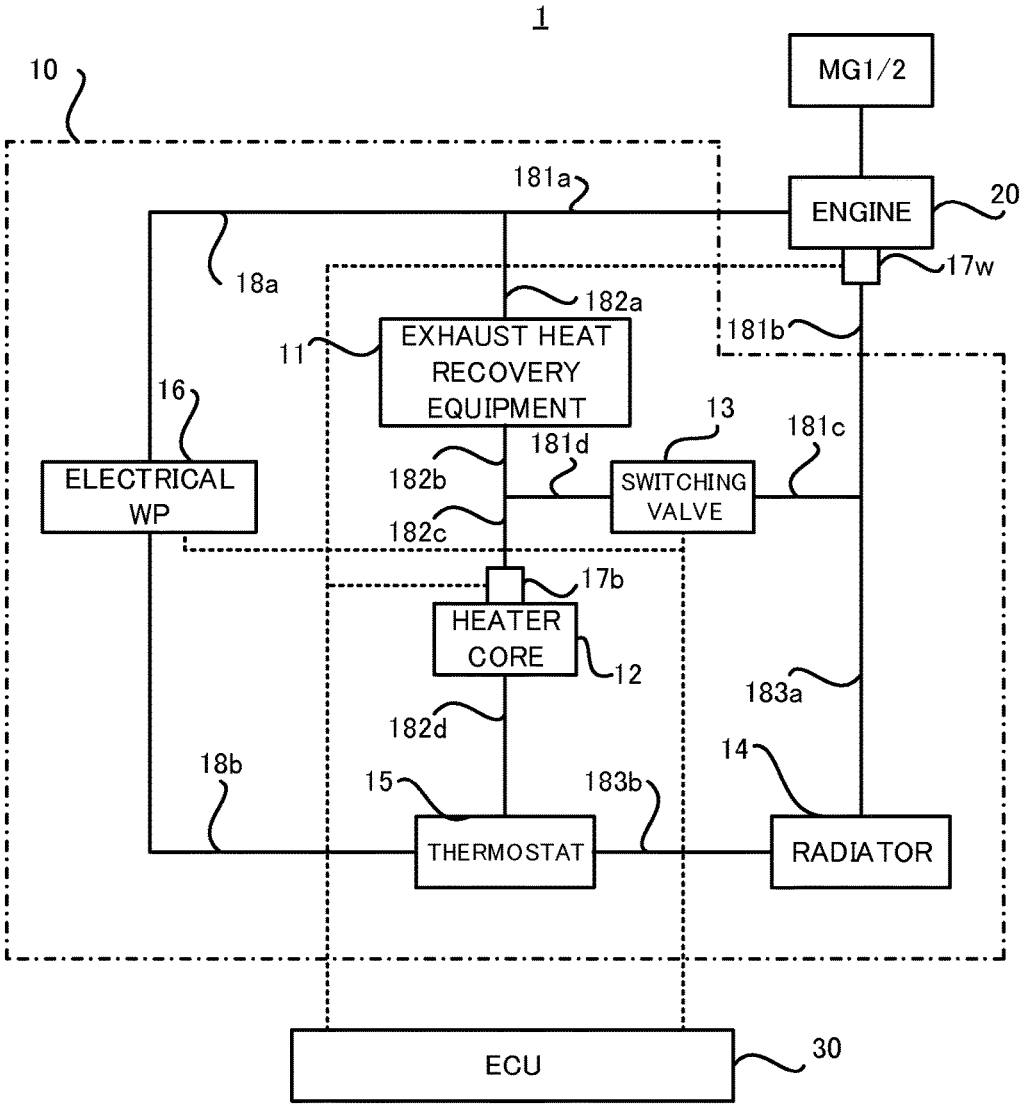

[FIG. 4]
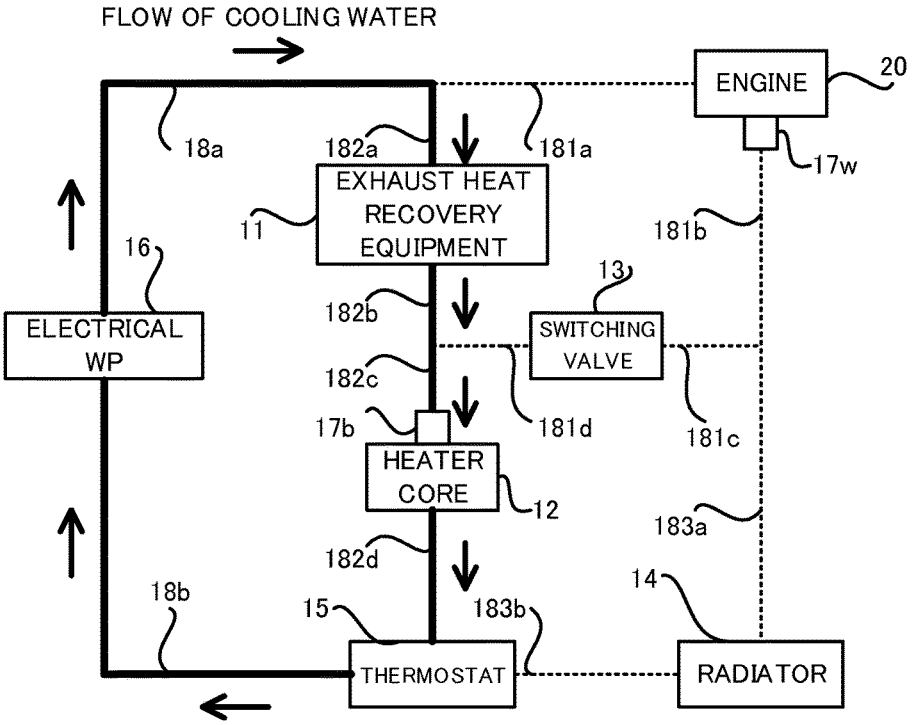
[FIG. 5]
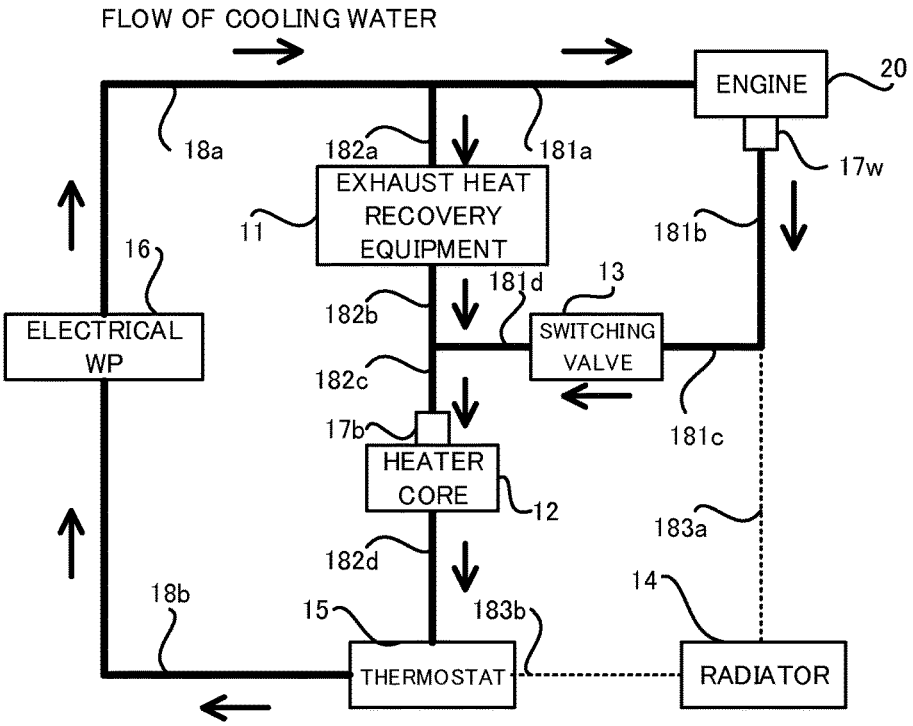

[FIG. 6]
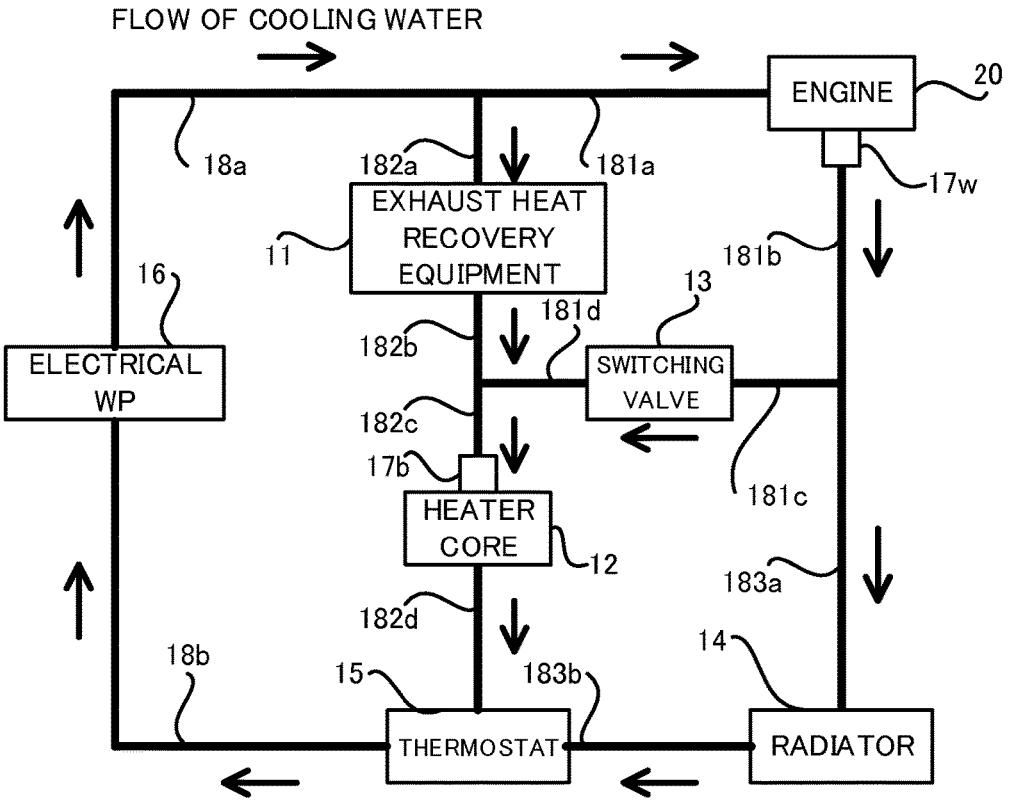

[FIG. 7]
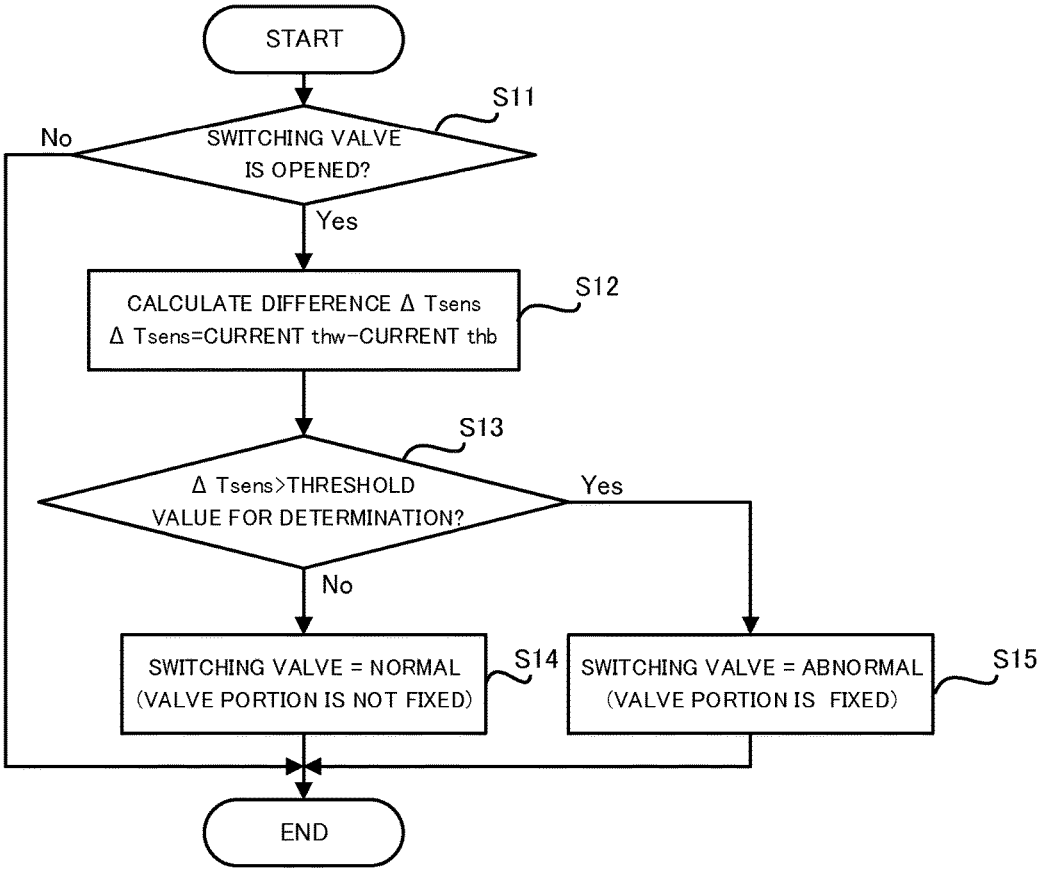

[FIG. 8]
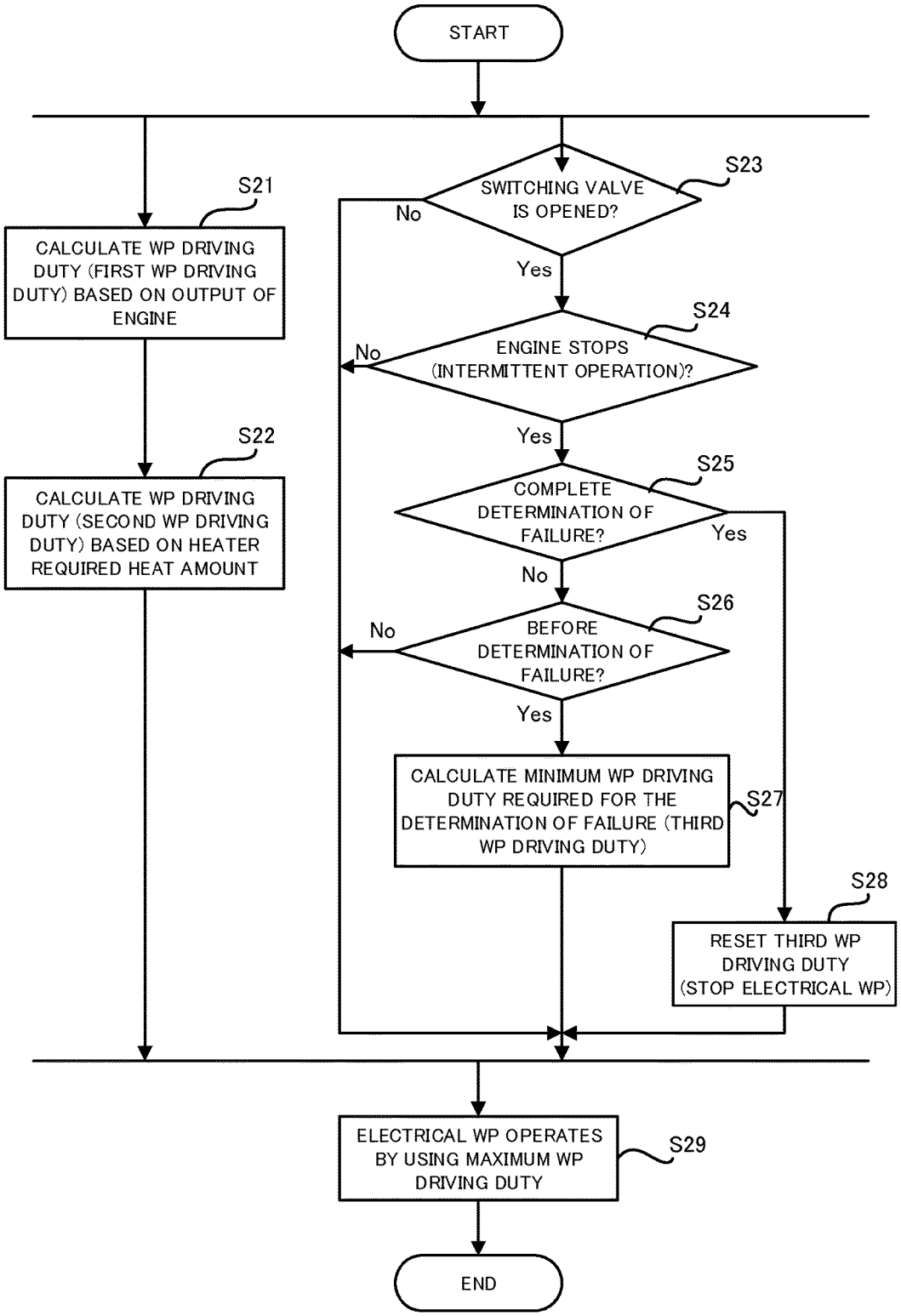

COOLING WATER CONTROL APPARATUS

CROSS-REFERENCE TO RELATED APPLICATION

This is a national phase application based on the PCT International Patent Application No. PCT/JP2013/062619 filed Apr. 30, 2013, the entire contents of which are incorporated herein by reference.

TECHNICAL FIELD

The present invention relates to a cooling water control apparatus for controlling a cooling apparatus which cools and/or warms an engine by circulating cooling water, for example.

BACKGROUND ART

A cooling apparatus for circulating a cooling water in order to cool and/or warm an engine is known heretofore. For example, a Patent Literature 1 discloses a cooling apparatus in which a first cooling water passage which circulates the cooling water and which passes through an inside of the engine and a second cooling water passage which circulates the cooling water and which does not pass through the inside of the engine are connected via a valve. According to the Patent Literature 1, the first cooling water passage is mainly used for cooling and/or warming the engine and second cooling water passage is mainly used for recovering exhaust heat from the engine.

Here, according to the Patent Literature 1, it is determined whether or not there is a closed failure of the valve, which connects the first and second cooling water passages, on the basis of a difference between temperature of the cooling water in the first cooling water passage and temperature of the cooling water in the second cooling water passage. This is because the temperature of the cooling water in the first cooling water passage which passes through the engine has relatively strong tendency to increase more rapidly than the temperature of the cooling water in the second cooling water passage which does not pass through the engine (namely, the difference between both temperatures has relatively strong tendency to increase), when the valve which should be opened is closed.

Incidentally, a Patent Literature 2 is listed as a background art which is related to the present invention.

CITATION LIST

Patent Literature

[Patent Literature 1] Japanese Patent No. 4883225
[Patent Literature 2] Japanese Patent Application Laid Open No. 2011-102545

SUMMARY OF INVENTION

Technical Problem

It is therefore an object of the present invention to provide, for example, a cooling water control apparatus which is capable of determining whether or not there is a failure of a valve in an aspect which is different from or better than the aspect of the technology disclosed in the Patent Literature 1, in a cooling apparatus in which a first pipe which circulates cooling water and which passes through an inside of an engine and a second pipe which circulates the cooling water and which does not pass through the inside of the engine are connected via the valve.

Solution to Problem

<1>

A disclosed cooling water control apparatus is a cooling water control apparatus for controlling a cooling apparatus, the cooling apparatus being provided with: (i) a first pipe which circulates a cooling water and which passes through an inside of an engine; (ii) a second pipe which circulates the cooling water and which does not pass through the inside of the engine; (iii) a switching valve which is disposed at a downstream side of the engine, a state of the switching valve being changed between an opened state and a closed state in accordance with a command, the opened state allowing a first flow amount of cooling water to flow from the first pipe to the second pipe, the closed state allowing a second flow amount of cooling water to flow from the first pipe to the second pipe, the second flow amount being less than the first flow amount; and (iv) a supplying mechanism which supplies the cooling water to the first and second pipes, the cooling water control apparatus comprising: a determining device which determines whether or not there is a failure of the switching valve on the basis of a difference between a first temperature of the cooling water in the first pipe and a second temperature of the cooling water in the second pipe after the command for changing the state of the switching valve from the closed state to the opened state is outputted; and a controlling device which controls the supplying mechanism to supply the cooling water even after the engine stops, if the engine stops while the determining device is determining whether or not there is the failure of the switching valve.

The disclosed cooling water control apparatus is capable of controlling the cooling apparatus which cools the engine by circulating the cooling water.

The cooling apparatus is provided with: the first pipe, the second pipe; the switching valve; and the supplying mechanism.

The first pipe is a cooling water pipe for circulating the cooling water through the inside of the engine (for example, a water jacket of the engine). On the other hand, the second pipe is a cooling water pipe for circulating the cooling water not through the inside of the engine (in other words, while bypassing the engine).

The first and second pipes are connected (in other words, coupled) via the switching valve. Especially, the switching valve connects the first and second pipes at a position on the downstream side of the engine (namely, on more downstream side than the engine along a flowing direction of the cooling water). Incidentally, since the first pipe circulates the cooling water while passing through the inside of the engine and the second pipe circulates the cooling water while not passing through the inside of the engine, the switching valve may connect a pipe portion of the first pipe which is located at the downstream side of the engine and the second pipe.

The switching valve changes the state of the switching valve from the closed state to the opened state or from the opened state to the closed state in accordance with the command for changing the state of the switching valve. The switching valve whose state is the opened state allows the first flow amount of the cooling water to flow from the first pipe to the second pipe. On the other hand, the switching valve whose state is the closed state allows the second flow amount (the second flow amount is less than the first flow amount) of the cooling water to flow from the first pipe to the second pipe. In this case, the switching valve whose state is the closed state may stop the flow of the cooling water from the first pipe to the second pipe. In other words, the switching valve whose state is the closed state may set the flow amount of the cooling water which flows from the first pipe to the second pipe to zero.

The supplying mechanism supplies the cooling water to the first pipe. As a result, the cooling water circulates in the first pipe. Similarly, the supplying mechanism supplies the cooling water to the second pipe. As a result, the cooling water circulates in the second pipe.

The cooling water control apparatus determines whether or not there is the failure of the switching valve in the above described cooling apparatus. Especially, it is preferable that the cooling water control apparatus determines whether or not there is the failure of the switching valve by which the state of the switching valve cannot be changed to the opened state (namely, the failure by which the first flow amount of the cooling water is not capable of flowing from the first pipe to the second pipe). In other words, it is preferable that the cooling water control apparatus determines whether or not there is the failure of the switching valve by which the state of the switching valve is fixed to the closed state (namely, the failure by which only a flow amount, which is less than the first flow amount, of the cooling water flows from the first pipe to the second pipe).

In order to determine whether or not there is the failure of the switching valve, the cooling water control apparatus is provided with: the determining device and the controlling device.

The determining device determines whether or not there is the failure of the switching valve after the command for changing the state of the switching valve from the closed state to the opened state is outputted. In this case, the determining device determines whether or not there is the failure of the switching valve on the basis of the difference between the first temperature which is the temperature of the cooling water in the first pipe and the second temperature which is the temperature of the cooling water in the second pipe. Especially, the determining device may determine whether or not there is the failure of the switching valve on the basis of the difference between the first temperature which is the temperature of the cooling water in a pipe portion of the first pipe which is located at a downstream side of the engine (moreover, at an upstream side of the switching valve) and the second temperature which is the temperature of the cooling water in a pipe portion of the second pipe which is located at a downstream side of the switching valve.

Here, when there is not the failure of the switching valve, the state of the switching valve is changed to the opened state after the command for changing the state of the switching valve from the closed state to the opened state. As a result, the first flow amount (namely, a relatively large flow amount) of the cooling water flows from the first pipe to the second pipe. Namely, the cooling water flows from the first pipe to the second pipe relatively easily. Thus, the difference between the first and second temperatures is relatively small, because the cooling water in the first pipe is mixed with the cooling water in the second pipe relatively easily.

On the other hand, when there is the failure of the switching valve, the state of the switching valve is not changed to the opened state after the command for changing the state of the switching valve from the closed state to the opened state. As a result, the second flow amount (namely, a relatively small flow amount) of the cooling water flows from the first pipe to the second pipe. Alternatively, the cooling water does not flow from the first pipe to the second pipe. Namely, the cooling water does not flow from the first pipe to the second pipe relatively easily. Thus, the difference between the first and second temperatures is relatively large, because the cooling water in the first pipe is not mixed with the cooling water in the second pipe relatively easily.

Thus, the determining device may determine that there is the failure of the switching valve when the difference between the first and second temperatures is larger than a predetermined threshold value. In other words, the determining device may determine that there is not the failure of the switching valve when the difference between the first and second temperatures is not larger than the predetermined threshold value.

By the way, the "difference between the first and second temperatures", which is used by the determining device to determine whether or not there is the failure of the switching valve, is a value which depends on a degree of the flow amount of the cooling water flowing from the first pipe to the second pipe, as described above. Therefore, it is preferable that the supplying device keep supplying the cooling water to the first and second pipes during a period when the determining device determines whether or not there is the failure of the switching valve, in order to maintain accuracy of the determination by the determining device.

On the other hand, the engine sometimes stops temporarily to improve fuel efficiency or environmental performance. For example, when the cooling apparatus is mounted on a hybrid vehicle which is provided with both of the engine and a rotating electrical machine, the engine may operate in an intermittent operation mode by which the engine temporarily stops. In this case, since the engine stops, there is little need to cool the engine. Thus, when the engine stops, the supplying mechanism also stops (namely, does not supply the cooling water to the first and second pipes) usually. However, if the supplying mechanism stops due to the stop of the engine during the period when the determining device determines whether or not there is the failure of the switching valve, there is a possibility that the accuracy of the determination by the determining device deteriorates.

Thus, the controlling device controls the supplying mechanism to supply the cooling water to at least one of the first and second pipes even after the engine stops, when the engine stops during the period when the determining device determines whether or not there is the failure of the switching valve. In this case, the controlling device may control the supplying mechanism to supply a predetermined flow amount of the cooling water to at least one of the first and second pipes during the period which is required for the determining device to determine whether or not there is the failure of the switching valve. Moreover, the controlling device may control the supplying mechanism to supply the minimum flow amount of the cooling water to at least one of the first and second pipes in order to prevent a deterioration of the fuel efficiency (for example, an increase of the electrical power consumed by the supplying mechanism) which is caused by the supply of the cooling water performed by the supplying mechanism after the engine stops.

As described above, according to the disclosed cooling water control apparatus, there is little or no possibility that the accuracy of the determination by the determining device deteriorates, because the supplying mechanism does not stop even when the engine stops during the period when the determining device determines whether or not there is the failure of the switching valve. Therefore, the cooling water control apparatus is capable of appropriately determining whether or not there is the failure of the switching valve.

<2>

In another aspect of the disclosed cooling water control apparatus, the cooling apparatus is mounted on a vehicle which travels by using an output of the engine, the controlling device controls the supplying mechanism such that a flow amount of the cooling water which is supplied by the supplying mechanism becomes larger as a speed of the vehicle becomes higher.

According to this aspect, the cooling apparatus is mounted on the vehicle which travels by using the output of the engine.

Here, when the speed of the vehicle is relatively high, there is a high possibility that the output of the engine is relatively large at a timing before the engine stops, compared to the case where the speed of the vehicle is relatively low. Therefore, there is a high possibility that the first temperature is relatively high. If the switching valve keeps in the failure state under this situation, a decrease of the first temperature is not facilitated and thus there is a possibility that overheat or the like of the engine arises. Therefore, when the speed of the vehicle is relatively high, it is preferable that the determining device determine whether or not there is the failure of the switching valve relatively quickly, compared to the case where the speed of the vehicle is relatively low.

On the other hand, the determining device is capable of determining whether or not there is the failure of the switching valve more quickly as the flow amount of the cooling water which is supplied by the supplying mechanism is larger. The reason is as follows. The cooling water flows from the first pipe to the second pipe more easily as the flow amount of the cooling water which is supplied by the supplying mechanism is larger. Therefore, when there is not the failure of the switching valve, the difference between the first and second temperatures decreases relatively rapidly. Namely, a time which is required for the difference between the first and second temperatures to be smaller than the predetermined threshold value in the case where the flow amount of the cooling water which is supplied by the supplying mechanism is relatively large is shorter than a time which is required for the difference between the first and second temperatures to be smaller than the predetermined threshold value in the case where the flow amount of the cooling water which is supplied by the supplying mechanism is relatively small. Thus, the determining device is capable of determining whether or not the difference between the first and second temperatures is relatively large (alternatively, the difference between the first and second temperatures is larger than the predetermined threshold value) more quickly as the flow amount of the cooling water which is supplied by the supplying mechanism is larger. Namely, the determining device is capable of determining whether or not there is the failure of the switching valve more quickly as the flow amount of the cooling water which is supplied by the supplying mechanism is larger.

Thus, in this aspect, the controlling device controls the supplying mechanism such that the flow amount of the cooling water which is supplied by the supplying mechanism (namely, the flow amount of the cooling water which is supplied by the supplying mechanism after the engine stops) becomes larger as the speed of the vehicle becomes higher. Therefore, the controlling device is capable of determining whether or not there is the failure of the switching valve quickly under the situation that it is desired to determine whether or not there is the failure of the switching valve relatively quickly (in this aspect, under the situation that the speed of the vehicle is relatively high).

<3>

In another aspect of the disclosed cooling water control apparatus, the cooling apparatus is mounted on a hybrid vehicle which travels by using at least one of an output of the engine and an output of a rotating electrical machine which operates by using electrical power stored in a battery, the controlling device controls the supplying mechanism such that a flow amount of the cooling water which is supplied by the supplying mechanism becomes larger as a residual power of the battery becomes smaller.

According to this aspect, the cooling apparatus is mounted on the hybrid vehicle which travels by using at least one of the output of the engine and the output of the rotating electrical machine.

Here, when the residual power (for example, a SOC: State Of Charge) is relatively small, the rotating electrical machine does not operate so frequently (in other words, there is small remaining capacity for the rotating electrical machine to operate), compared to the case where the residual power is relatively large. Thus, when the residual power is relatively small, there is high possibility that the engine operates frequently, compared to the case where the residual power is relatively large. Namely, when the residual power is relatively small, there is a high possibility that the output of the engine is relatively large at a timing before the engine stops, compared to the case where the residual power is relatively large. Therefore, there is a high possibility that the first temperature is relatively high. If the switching valve keeps in the failure state under this situation, the decrease of the first temperature is not facilitated and thus there is a possibility that the overheat or the like of the engine arises. Therefore, when the residual power is relatively small, it is preferable that the determining device determine whether or not there is the failure of the switching valve relatively quickly, compared to the case where the residual power is relatively large.

On the other hand, as described above, the determining device is capable of determining whether or not there is the failure of the switching valve more quickly as the flow amount of the cooling water which is supplied by the supplying mechanism is larger.

Thus, in this aspect, the controlling device controls the supplying mechanism such that the flow amount of the cooling water which is supplied by the supplying mechanism (namely, the flow amount of the cooling water which is supplied by the supplying mechanism after the engine stops) becomes larger as the residual power becomes smaller. Therefore, the controlling device is capable of determining whether or not there is the failure of the switching valve quickly under the situation that it is desired to determine whether or not there is the failure of the switching valve relatively quickly (in this aspect, under the situation that the residual power is relatively small).

<4>

In another aspect of the disclosed cooling water control apparatus, the controlling device controls the supplying mechanism to supply the cooling water when a predetermined time does not lapse after the engine stops, and controls the supplying mechanism not to supply the cooling water when the predetermined time lapses after the engine stops.

According to this aspect, the controlling device controls the supplying mechanism to supply the cooling water even after the engine stops during only the predetermined time after the engine stops. Namely, the controlling device may control the supplying mechanism not to supply the cooling water when the predetermined time lapses after the engine stops. Therefore, the period during which the supplying mechanism supplies the cooling water after the engine stops is limited to the minimum. As a result, the deterioration of the fuel efficiency (for example, the increase of the electrical power consumed by the supplying mechanism) which is caused by the supply of the cooling water performed by the supplying mechanism is suppressed to the minimum.

<5>

In another aspect of the disclosed cooling water control apparatus which controls the supplying mechanism to supply the cooling water when the predetermined time does not lapse after the engine stops, the predetermined time is a time which is required for the determining device to determine whether or not there is the failure of the switching valve.

According to this aspect, the period during which the supplying mechanism supplies the cooling water after the engine stops is limited to the minimum and the determining device is capable of appropriately determining whether or not there is the failure of the switching valve.

<6>

In another aspect of the disclosed cooling water control apparatus, the switching valve is provided with: (i) a valve portion which opens a passage between the first and second pipes such that the first flow amount of the cooling water flows from the first pipe to the second pipe when the state of the switching valve is the opened state and which closes the passage between the first and second pipes when the state of the switching valve is the closed state; and (ii) a micro flowing portion which allows the second flow amount of the cooling water to flow from the first pipe to the second pipe when the state of the switching valve is the closed state, the determining device determines whether or not there is a failure of the valve portion According to this aspect, the switching valve is capable of allowing the second flow amount of the cooling water to flow from the first pipe to the second pipe even if the valve portion closes the passage between the first and second pipes, because the switching valve is provided with the micro flowing portion (for example, a micro flowing hole or a micro flowing pipe which is described later). The determining device is capable of appropriately determining whether or not there is a failure of the valve portion in this switching valve.

The operation and other advantages of the present invention will become more apparent from embodiments explained below.

BRIEF DESCRIPTION OF DRAWINGS

FIG. 1 is a block diagram illustrating one example of a structure of a hybrid vehicle of the present embodiment.

FIG. 2 is a block diagram illustrating a structure of a cooling apparatus which the hybrid vehicle of the present embodiment is provided with.

FIG. 4 is a block diagram illustrating the circulation aspect of the cooling water when the engine water temperature is within a first range.

FIG. 5 is a block diagram illustrating the circulation aspect of the cooling water when the engine water temperature is within a second range which is higher than the first range.

FIG. 6 is a block diagram illustrating the circulation aspect of the cooling water when the engine water temperature is within a third range which is higher than the second range.

FIG. 7 is a flowchart illustrating the flow of the operation of determining whether or not there is the failure of the switching valve.

FIG. 8 is a flowchart illustrating a flow of the operation of controlling the electrical WP to operate.

DESCRIPTION OF EMBODIMENTS

Figure 3A:
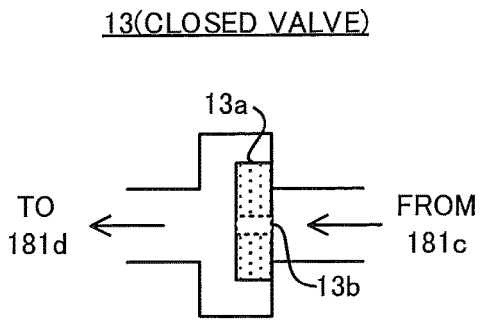
FIG. 3 are cross-sectional views illustrating a structure of a switching valve of the present embodiment.
Figure 3B:
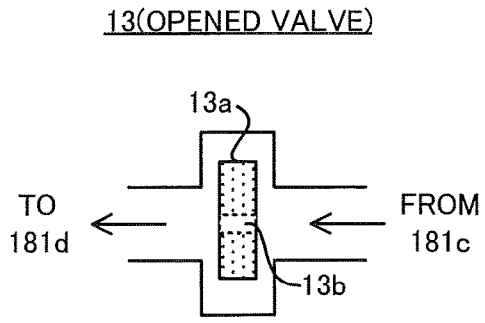
Figure 3C:
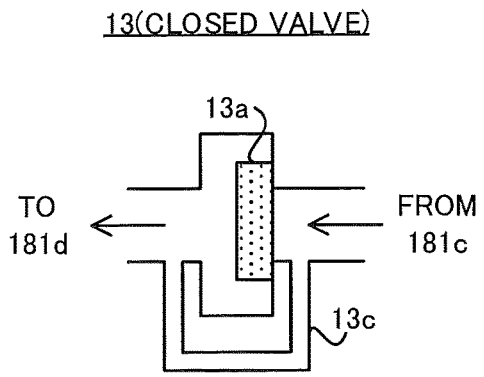
Figure 3D:
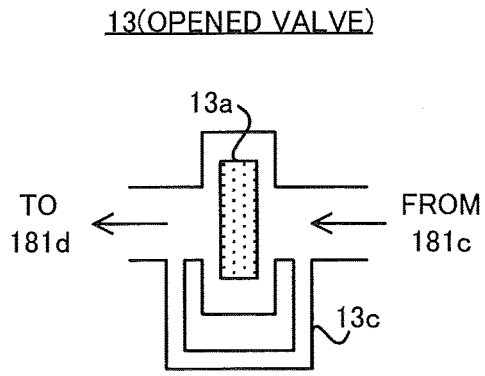

Hereinafter, a vehicle 1 which is provided with a cooling apparatus 10 will be explained, as an embodiment of the present invention, with reference to the drawings.

(1) Structure of Hybrid Vehicle

Firstly, with reference to FIG. 1, a structure of a hybrid vehicle 1 of the present embodiment will be explained. FIG. 1 is a block diagram illustrating one example of the structure of the hybrid vehicle 1 of the present embodiment.

As illustrated in FIG. 1, the hybrid vehicle 1 is provided with an axle shaft 210, wheels 220, an engine 20, an ECU 30, a motor generator MG1, a motor generator MG2, a transaxle 300, an inverter 400, a battery 500, SOC (State Of Charge) sensor 510 and a speed sensor 600.

The axle shaft 210 is a transmission shaft which transmits the driving power outputted from the engine 20 and the motor generator MG2 to the wheels.

The wheel 220 is a device for transmitting the driving power which is transmitted via the below described axle shaft 210 to a road. FIG. 1 illustrates an example in which the hybrid vehicle 1 is provided with one wheel 220 at each of right and left sides. However, it is actually preferable that the hybrid vehicle 1 be provided with one wheel 220 at each of a front-right side, a front-left side, a rear-right side and a rea-left side (namely, have four wheels 220 in total).

The ECU 30 is an electrical controlling unit which is configured to control the whole of the operation of the hybrid vehicle 1. The ECU 30 is provided with a CPU (Central Processing Unit), a ROM (Read Only Memory), a RAM (Random Access Memory) and so on.

The engine 20 is a gasoline engine or a diesel engine which is one example of the "engine", and functions as a main driving power source of the hybrid vehicle 1.

The motor generator MG1 is one example of the "rotating electrical machine", and functions as a generator for charging the battery 500 or for supplying an electrical power to the motor generator MG2. Furthermore, the motor generator MG1 functions as a motor for assisting a driving power of the engine 20.

The motor generator MG2 is one example of the "rotating electrical machine", and functions as the motor for assisting the driving power of the engine 20. Furthermore, the motor generator MG2 functions as the generator for charging the battery 500.

Incidentally, each of the motor generators MG1 and MG2 is a synchronous electrical motor generator. Therefore, each of the motor generators MG1 and MG2 is provided with a rotor having a plurality of permanent magnets on an outer surface thereof and a stator to which a three-phase coil for forming a rotating magnetic field is wound. However, at least one of the motor generators MG1 and MG2 may be another type of the motor generator.

The transaxle 300 is a power transmission mechanism in which a transmission, a differential gear and the like are unified. Especially, the transaxle 300 is provided with a power dividing mechanism 310.

The power dividing mechanism 310 is a planetary gear train including a sun gear, a planetary carrier, a pinion gear and a ring gear which are not illustrated. A rotating shaft of the sun gear which is located at an inner circumference is coupled with the motor generator MG1 and a rotating shaft of the ring gear which is located at an outer circumference is coupled with the motor generator MG2 among these gears. A rotating shaft of the planetary carrier which is located between the sun gear and the ring gear is coupled with the engine 20, a rotation of the engine 20 is transmitted to the sun gear and the ring gear by this planetary carrier and moreover the pinion gear, and the driving power of the engine 20 is configured to be divided into two channels. In the hybrid vehicle 1, the rotating shaft of the ring gear is coupled with the axle shaft 210 of the hybrid vehicle 1 and the driving power is transmitted to the wheels 220 via the axle shaft 210.

The inverter 400 is configured to be capable of converting a DC (Direct Current) electrical power which is outputted from the battery 500 into an AC (Alternating Current) electrical power to supply it to the motor generators MG1 and MG2, and converting the AC electrical power which is generated by the motor generators MG1 and MG2 into the DC electrical power to supply it to the battery 500. Incidentally, the inverter 400 may be configured to be one portion of what we call a PCU (Power Control Unit)

The battery 500 is a rechargeable battery which is configured to be capable of functioning as an electrical power source of the electrical power which is used by the motor generators MG1 and MG2 to operate.

Incidentally, the battery 500 may be charged by receiving the supply of the electrical power from an electrical source which is located at an outside of the hybrid vehicle 1. Namely, the hybrid vehicle 1 may be what we call a plug-in hybrid vehicle.

The SOC sensor 510 is a sensor which is configured to be capable of detecting a SOC value which is a remaining (residual) battery level for representing a charge state of the battery 500. The SOC sensor 510 is electrically connected to the ECU 30 and the SOC value of the battery 500 which is detected by the SOC sensor 510 is configured to be always monitored by the ECU 30.

The speed sensor 600 is a sensor which is configured to be capable of detecting a speed V of the hybrid vehicle 1. The speed V of the hybrid vehicle 1 which is detected by the speed sensor 600 is configured to be always monitored by the ECU 30.

(2) Structure of Cooling Apparatus

Next, with reference to FIG. 2, a structure of a cooling apparatus 10 which the hybrid vehicle 1 of the present embodiment is provided with will be explained. FIG. 2 is a block diagram illustrating the structure of the cooling apparatus 10 which the hybrid vehicle 1 of the present embodiment is provided with.

As illustrated in FIG. 2, the cooling apparatus 10 is provided with: a switching valve 13; an electrical WP (Water Pump) 16; a water temperature sensor 17*b*; and a water temperature sensor 17*w*. Furthermore, the cooling apparatus 10 may be provided with: an exhaust heat recovery equipment 11; a heater core 12; a radiator 14; and a thermostat 15. Moreover, the cooling apparatus 10 is provided with a cooling water pipe 18 which is constructed from a cooling water pipe 18*a*; a cooling water pipe 18*b*; a cooling water pipe 181*a*; a cooling water pipe 181*b*; a cooling water pipe 181*c*; a cooling water pipe 181*d*; a cooling water pipe 182*a*; a cooling water pipe 182*b*; a cooling water pipe 182*c*; a cooling water pipe 182*d*; a cooling water pipe 183*a*; and a cooling water pipe 183*b*.

The electrical WP 16 is a pump which ejects a desired flow amount of cooling water. The cooling water which is ejected from the electric WP 16 flows into the cooling water pipe 18*a*. The cooling water pipe 18*a* branches into the cooling water pipe 181*a* and the cooling water pipe 182*a*.

The cooling water pipe 181*a* is connected to the engine 20. The cooling water pipe 181*b* extends from the engine 20. The cooling water pipe 181*b* branches into the cooling water pipe 181*c* which is connected to the switching valve 13 and the cooling water pipe 183*a* which is connected to the radiator 14. The cooling water pipe 181*d* extends from the switching valve 13. The cooling water pipe 181*d* joins the cooling water pipe 182*b* which extends from the exhaust heat recovery equipment 11, and is connected to the cooling water pipe 182*c* which is connected to the heater core 12. The cooling water pipe 182*d* which is connected to the thermostat 15 extends from the heater core 12. The cooling water pipe 18*b* which is connected to the electrical WP 16 extends from the thermostat 15. Namely, the cooling water which is ejected from the electric WP 16 returns to the electric WP 16 by passing through the cooling water pipe 18*a*, the cooling water pipe 181*a*, the cooling water pipe 181*b*, the cooling water pipe 181*c*, the cooling water pipe 181*d*, the cooling water pipe 182*c*, the cooling water pipe 182*d* and the cooling water pipe 18*b* in this order. Namely, the cooling water pipe 18*a*, the cooling water pipe 181*a*, the cooling water pipe 181*b*, the cooling water pipe 181*c*, the cooling water pipe 181*d*, the cooling water pipe 182*c*, the cooling water pipe 182*d* and the cooling water pipe 18*b* form a main pipe which passes through the engine 20 (i.e. does not bypass the engine 20) and does not pass through the radiator 14 (i.e. bypasses the radiator 14). Incidentally, the main pipe is one example of the above described "first pipe".

On the other hand, the cooling water pipe 182*a* is connected to the exhaust heat recovery equipment 11. The cooling water pipe 182*b* extends from the exhaust heat recovery equipment 11. The cooling water pipe 182*b* joins the cooling water pipe 181*d* which extends from the switching valve 13, and is connected to the cooling water pipe 182*c* which is connected to the heater core 12. Namely, the cooling water which is ejected from the electric WP 16 returns to the electric WP 16 by passing through the cooling water pipe 18*a*, the cooling water pipe 182*a*, the cooling water pipe 182*b*, the cooling water pipe 182*c*, the cooling water pipe 182*d* and the cooling water pipe 18*b* in this order. Namely, the cooling water pipe 18*a*, the cooling water pipe 182*a*, the cooling water pipe 182*b*, the cooling water pipe 182*c*, the cooling water pipe 182*d* and the cooling water pipe 18*b* form a bypass pipe which does not pass through the engine 20 (i.e. bypasses the engine 20). Incidentally, the bypass pipe is one example of the above described "second pipe".

On the other hand, the cooling water pipe 183*b*, which is connected to the thermostat 15, extends from the radiator 14. Namely, the cooling water which is ejected from the electric WP 16 returns to the electric WP 16 by passing through the cooling water pipe 18*a*, the cooling water pipe 181*a*, the cooling water pipe 181*b*, the cooling water pipe 183*a*, the cooling water pipe 183*b* and the cooling water pipe 18*b* in this order. Namely, the cooling water pipe 18*a*, the cooling water pipe 181*a*, the cooling water pipe 181*b*, the cooling water pipe 183*a*, the cooling water pipe 183*b* and the cooling water pipe 18*b* form a sub pipe which passes through the engine 20 (i.e. does not bypass the engine 20) and passes through the radiator 14 (i.e. does not bypass the radiator 14).

The cooling water flows into an engine block of the engine 20 from the cooling water pipe 181*a*. The cooling water which flows into the engine 20 passes through a water jacket of the engine 20. The cooling water which passes through the water jacket flows outwardly from an engine head of the engine 20 to the cooling water pipe 181*b*. The water jacket is located around a cylinder (not illustrated) in the engine 20. The cylinder exchanges heat with the cooling water which passes through the water jacket. As a result, the engine 20 is cooled.

The water temperature sensor 17*w* measures a temperature (hereinafter, it is referred to as an "engine water temperature") thw of the cooling water which passes through the engine 20. Especially, the water temperature sensor 17*w* is disposed at the cooling water pipe 181*b* which is located between the water jacket of the engine 20 and the switching valve 13. However, the water temperature sensor 17*w* may be disposed at the cooling water pipe 181*c* which is located between the water jacket of the engine 20 and the switching valve 13. Namely, in the present embodiment, a temperature of the cooling water which passes through the cooling water pipe 181*b* located between the water jacket of the engine 20 and the switching valve 13 is used as the engine water temperature thw. The engine water temperature thw which is measured by the water temperature sensor 17*w* is outputted to the ECU 30.

The exhausting heat recovery equipment 11 is located on an exhaust pipe (not illustrated) through which an exhaust gas ejected from the engine 20 passes. The cooling water passes through the exhausting heat recovery equipment 11. The exhausting heat recovery equipment 11 recovers an exhaust heat by exchanging a heat between the cooling water which pass through therein and the exhaust gas. Namely, the exhausting heat recovery equipment 11 is capable of heating up the cooling water by using the heat of the exhaust gas.

The heater core 12 recovers the heat of the cooling water by exchanging the heat between the air and the cooling water which pass through the heater core 12. The air heated by the heat which is recovered by the heater core 12 is blew into a vehicle cabin by a fan which is referred to as a heater blower (not illustrated) for the purpose of a heater, a defroster, a deice and the like.

The water temperature sensor 17*b* measures a temperature (hereinafter, it is referred to as a "bypass water temperature") thb of the cooling water which flows into the heater core 12. Especially, the water temperature sensor 17*b* is disposed at the bypass pipe (for example, the cooling water pipe 182*c* which is located between the switching valve 13 and the heater core 12). Namely, in the present embodiment, a temperature of the cooling water which passes through the cooling water pipe 182*c* located between the switching valve 13 and the heater core 12 is used as the bypass water temperature thb. However, a temperature of the cooling water which passes through one portion of the bypass pipe (for example, the cooling water pipe 182*a*, the cooling water pipe 182*b* or the cooling water pipe 182*d*) may be used as the bypass water temperature thb. The bypass water temperature thb which is measured by the water temperature sensor 17*b* is outputted to the ECU 30.

The switching valve 13 is a valve (for example, a FCV (Flow Control Valve)) which is capable of changing an opened/closed state of a valve element 13*a* (see FIG. 3(*a*) to FIG. 3(*d*)), under the control of the ECU 30. For example, when the switching valve 13 is closed, the switching valve 13 prevents the cooling water from flowing from the cooling water pipe 181*c* to the cooling water pipe 181*d*. In this case, the cooling water remains in the cooling water pipe 181*a*, the cooling water pipe 181*b* and the cooling water pipe 181*c*. On the other hand, when the switching valve 13 is opened, the switching valve 13 allows the cooling water to flow from the cooling water pipe 181*c* to the cooling water pipe 181*d*. In this case, the cooling water flowing outwardly from the engine 20 to the cooling water pipe 181*b* flows into the heater core 12 via the cooling water pipe 181*c* and the cooling water pipe 181*d*. In addition, the switching valve 13 is capable of adjusting open degree of the valve element 13*a*, under the control of the ECU 30. Namely, the switching valve 13 is capable of adjusting the flow amount of the cooling water which flows outwardly from the switching valve 13 to the cooling water pipe 181*d* (substantially, the flow amount of the cooling water in the main pipe) and the flow amount of the cooling water which flows outwardly from the switching valve 13 to the cooling water pipe 183*a* (substantially, the flow amount of the cooling water in the sub pipe).

Here, with reference to FIG. 3(*a*) to FIG. 3(*d*), a structure of the switching valve 13 will be explained. FIG. 3(*a*) and FIG. 3(*b*) are cross-sectional views illustrating a first example of the structure of the switching valve 13. FIG. 3(*c*) and FIG. 3(*d*) are cross-sectional views illustrating a first example of the structure of the switching valve 13.

As illustrated in FIG. 3(*a*) and FIG. 3(*b*), the switching valve 13 may be provided with: the valve element 13*a* for physically closing (infilling, occluding) a space between the cooling water pipes 181*c* and 181*d*; and a micro flowing hole 13*b* which penetrates the valve element 13*a* in a direction along which the cooling water flows (namely, a direction from the cooling water pipe 181*c* to the cooling water pipe 181*d*).

In this case, when the switching valve 13 is closed, the valve element 13*a* physically closes the space between the cooling water pipes 181*c* and 181*d*. Therefore, the cooling water flows from the cooling water pipe 181*c* to the cooling water pipe 181*d* via the micro flowing hole 13*b*. On the other hand, when the switching valve 13 is opened, the valve element 13*a* moves such that the space (namely, the space which connects the cooling water pipes 181*c* and 181*d*) is formed between the cooling water pipes 181*c* and 181*d*. Therefore, the cooling water flows from the cooling water pipe 181*c* to the cooling water pipe 181*d* via the space around the valve element 13*a* in addition to or instead of the micro flowing hole 13*b*. Thus, the flow amount of the cooling water which flows from the cooling water pipe 181*c* to the cooling water pipe 181*d* when the switching valve 13 is opened is larger than the flow amount of the cooling water which flows from the cooling water pipe 181*c* to the cooling water pipe 181*d* when the switching valve 13 is closed.

Alternatively, as illustrated in FIG. 3(*c*) and FIG. 3(*c*), the switching valve 13 may be provided with: the valve element 13*a* for physically closing (infilling, occluding) the space between the cooling water pipes 181*c* and 181*d*; and a micro flowing pipe 13*c* which allows the cooling water to flow from the cooling water pipe 181*c* to the cooling water pipe 181*d* not through the valve element 13*a*.

In this case, when the switching valve 13 is closed, the valve element 13*a* physically closes the space between the cooling water pipes 181*c* and 181*d*. Therefore, the cooling water flows from the cooling water pipe 181*c* to the cooling water pipe 181*d* via the micro flowing pipe 13*c*. On the other hand, when the switching valve 13 is opened, the valve element 13*a* moves such that the space (namely, the space which connects the cooling water pipes 181*c* and 181*d*) is formed between the cooling water pipes 181*c* and 181*d*. Therefore, the cooling water flows from the cooling water pipe 181*c* to the cooling water pipe 181*d* via the space around the valve element 13*a* in addition to or instead of the micro flowing pipe 13*c*. Thus, the flow amount of the cooling water which flows from the cooling water pipe 181*c* to the cooling water pipe 181*d* when the switching valve 13 is opened is larger than the flow amount of the cooling water which flows from the cooling water pipe 181*c* to the cooling water pipe 181*d* when the switching valve 13 is closed.

Incidentally, the flow amount of the cooling water which flows from the cooling water pipe 181*c* to the cooling water pipe 181*d* may be appropriately adjusted in accordance with a moving distance of the valve element 13*a*.

Moreover, the switching valves 13 illustrated in FIG. 3(*a*) to FIG. 3(*d*) are examples, and the switching valve 13 whose structure is different from that of the switching valves 13 illustrated in FIG. 3(*a*) to FIG. 3(*d*) may be used. However, it is preferable that the switching valve 13 have a structure (for example, the above described micro flowing hole 13*b*, the above described micro flowing pipe 18*c*, or a structure which functions in a same manner as this hole or pipe) which is capable of allowing the cooling water to flow from the cooling water pipe 181*c* to the cooling water pipe 181*d* even when the switching valve 13 is closed. Alternatively, the switching valve 13 may not have the structure (for example, the above described micro flowing hole 13*b*, the above described micro flowing pipe 18*c*, or the structure which functions in a same manner as this hole or pipe) which is capable of allowing the cooling water to flow from the cooling water pipe 181*c* to the cooling water pipe 181*d* even when the switching valve 13 is closed.

Again in FIG. 2, in the radiator 14, the cooling water which passes through the radiator 14 is cooled by the air. In this case, the wind which is introduced by a rotation of the not-illustrated electrical fan facilitates the cooling of the cooling water in the radiator 14.

In addition, the thermostat 15 has a valve which is opened or closed depending on the temperature of the cooling water. Typically, the thermostat 15 opens its valve when the temperature of the cooling water is high (for example, is equal to or higher than a predetermined temperature). In this case, the cooling water pipe 183*b* is connected to the cooling water pipe 18*b* via the thermostat 15. As a result, the cooling water passes through the radiator 14. Thus, the cooling water is cooled and the excessive heating (overheat) of the engine 20 is prevented. On the other hand, the thermostat 15 closes its valve when the temperature of the cooling water is relatively low (for example, is not equal to or higher than the predetermined temperature). In this case, the cooling water does not pass through the radiator 14. Thus, the decrease of the temperature of the cooling water is prevented and the excessive cooling (overcool) of the engine 20 is prevented.

The electric WP 16 is configured to have an electric motor and circulates the cooling water in the cooling water pipe 18 by using the operation of the motor. Specifically, electric power is supplied to the electric WP 16 from a battery and a rotational number of the electric WP 16 and the like is controlled by a controlling signal supplied from the ECU 30. Incidentally, a mechanical water pump, which is capable of operating regardless of the operation of the engine 20 or in association with the operation of the engine 20 and being controlled by the ECU 30, may be used instead of the electric WP 16. Moreover, the electric WP 16 is one example of the "supplying mechanism".

The ECU 30 is one example of the "cooling water control apparatus" and determines whether or not there is a failure of the switching valve 13 of the cooling apparatus 10.

(3) Specific Example of Circulation Aspect of Cooling Water in Cooling Apparatus Next, with reference to FIG. 4 to FIG. 6, a circulation aspect of the cooling water in the cooling apparatus 10 will be explained. FIG. 4 is a block diagram illustrating the circulation aspect of the cooling water when the engine water temperature thw is within a first range. FIG. 5 is a block diagram illustrating the circulation aspect of the cooling water when the engine water temperature thw is within a second range which is higher than the first range. FIG. 6 is a block diagram illustrating the circulation aspect of the cooling water when the engine water temperature thw is within a third range which is higher than the second range.

Firstly, when the engine water temperature thw is within the first range (for example, a temperature range which is less than T1 degree Celsius) in which the warm-up of the engine 20 is not completed, the ECU 30 outputs a command for closing the switching valve 13 into the switching valve 13. As a result, the switching valve 13 is closed. Furthermore, in this case, the thermostat 15 is closed. Therefore, as illustrated in FIG. 4, the flow of the cooling water from the cooling water pipe 181*c* to the cooling water pipe 181*d* and the flow of the cooling water from the cooling water pipe 183*b* to the cooling water pipe 18*b* are prevented. Thus, the cooling water remains in the cooling water pipe 181*a*, the cooling water pipe 181*b*, the cooling water pipe 181*c* and the cooling water pipe 181*d* which form the main pipe. Similarly, the cooling water remains in the cooling water pipe 183*a* and the cooling water pipe 183*b* which form the sub pipe. On the other hand, the cooling water circulates in the cooling water pipe 18*a*, the cooling water pipe 182*a*, the cooling water pipe 182*b*, the cooling water pipe 182*c*, the cooling water pipe 182*d* and the cooling water pipe 18*b* which form the bypass pipe. Incidentally, the arrows in FIG. 4 illustrate the flowing direction of the cooling water.

On the other hand, when the engine water temperature thw is within the second range (for example, a temperature range which is equal to or more than T1 degree Celsius and is less than T2 (T2>T1) degree Celsius) in which the warm-up of the engine 20 is completed and the thermostat 15 is not opened, the ECU 30 outputs a command for opening the switching valve 13 into the switching valve 13. As a result, the switching valve 13 is opened. Furthermore, in this case, the thermostat 15 is closed. Therefore, as illustrated in FIG. 5, the flow of the cooling water from the cooling water pipe 181*c* to the cooling water pipe 181*d* is allowed. On the other hand, the flow of the cooling water from the cooling water pipe 183*b* to the cooling water pipe 18*b* is prevented. Thus, the cooling water circulates in the cooling water pipe 181*a*, the cooling water pipe 181*b*, the cooling water pipe 181*c* and the cooling water pipe 181*d* which form the main pipe. Similarly, the cooling water circulates in the cooling water pipe 18*a*, the cooling water pipe 182*a*, the cooling water pipe 182*b*, the cooling water pipe 182*c*, the cooling water pipe 182*d* and the cooling water pipe 18*b* which form the bypass pipe. On the other hand, the cooling water remains in the cooling water pipe 183*a* and the cooling water pipe 183*b* which form the sub pipe. Incidentally, the arrows in FIG. 5 illustrate the flowing direction of the cooling water.

On the other hand, when the engine water temperature thw is within the third range (for example, a temperature range which is equal to or more than T2 degree Celsius) in which the thermostat 15 is opened, the ECU 30 outputs the command for opening the switching valve 13 into the switching valve 13. As a result, the switching valve 13 is opened. Furthermore, in this case, the thermostat 15 is opened. Therefore, as illustrated in FIG. 6, the flow of the cooling water from the cooling water pipe 181*c* to the cooling water pipe 181*d* and the flow of the cooling water from the cooling water pipe 183*b* to the cooling water pipe 18*b* are allowed. Thus, the cooling water circulates in the cooling water pipe 181*a*, the cooling water pipe 181*b*, the cooling water pipe 181*c* and the cooling water pipe 181*d* which form the main pipe. Similarly, the cooling water circulates in the cooling water pipe 183*a* and the cooling water pipe 183*b* which form the sub pipe. Similarly, the cooling water circulates in the cooling water pipe 18*a*, the cooling water pipe 182*a*, the cooling water pipe 182*b*, the cooling water pipe 182*c*, the cooling water pipe 182*d* and the cooling water pipe 18*b* which form the bypass pipe. Incidentally, the arrows in FIG. 6 illustrate the flowing direction of the cooling water.

(4) Flow of Operation of Determining Whether or not there is Failure of Switching Valve Next, with reference to FIG. 7, a flow of the operation of determining whether or not there is the failure of the switching valve 13. FIG. 7 is a flowchart illustrating the flow of the operation of determining whether or not there is the failure of the switching valve 13.

Incidentally, in the present embodiment, the failure of the switching valve 13 is regarded as a failure by which the switching valve 13 cannot be opened. The failure by which the switching valve 13 cannot be opened could be caused by a fixing of the valve portion 13*a* of the switching valve 13 (specifically, the fixing which physically closes the space between the cooling water pipes 181*c* and 181*d*), for example.

As illustrated in FIG. 7, the ECU 30 determines whether or not the command for opening the switching valve 13 is outputted (step S11). This is because it is determined whether or not there is the failure of the switching valve 13 after the switching valve 13 which is closed is newly opened, in the present embodiment.

As a result of the determination at the step S11, if it is determined that the command for opening the switching valve 13 is not outputted (step S11: No), the ECU 30 ends the operation. In this case, the ECU 30 may repeat the determining operation illustrated in FIG. 7 regularly or randomly.

On the other hand, as a result of the determination at the step S11, if it is determined that the command for opening the switching valve 13 is outputted (step S11: Yes), the ECU 30 determines whether or not there is the failure of the switching valve 13 on the basis of a difference ΔTsens (=the engine water temperature thw−the bypass water temperature thb) between the engine water temperature thw and the bypass water temperature thb (step S12 to step S15).

Here, the operation of determining whether or not there is the failure of the switching valve 13 on the basis of the difference ΔTsens between the engine water temperature thw and the bypass water temperature thb will be explained.

When there is not the failure of the switching valve 13, the switching valve 13 is opened after the command for opening the switching valve 13 is outputted. Therefore, the cooling water flows from the cooling water pipe 181*c* to the cooling water pipe 181*d* through the switching valve 13. Thus, the difference ΔTsens between the engine water temperature thw (namely, the temperature of the cooling water at the upstream side of the switching valve 13) and the bypass water temperature thb (namely, the temperature of the cooling water at the downstream side of the switching valve 13) is relatively small.

On the other hand, when there is the failure of the switching valve 13, the switching valve 13 is not opened after the command for opening the switching valve 13 is outputted. In other words, the switching valve 13 continues to be closed. Therefore, only the micro flowing hole 13*b* (alternatively, the micro flowing pipe 13*c*) is a flowing passage of the cooling water from the cooling water pipe 181*c* to the cooling water pipe 181*d*. As a result, the cooling water does not flow from the cooling water pipe 181*c* to the cooling water pipe 181*d* through the switching valve 13 easily. Alternatively, the cooling water remains in the main pipe. Thus, the engine water temperature thw increases due to the heat of the engine 20 more easily than the bypass water temperature thb. Therefore, the difference ΔTsens between the engine water temperature thw (namely, the temperature of the cooling water at the upstream side of the switching valve 13) and the bypass water temperature thb (namely, the temperature of the cooling water at the downstream side of the switching valve 13) is relatively large, when there is the failure of the switching valve 13.

Thus, the ECU 30 is capable of determining whether or not there is the failure of the switching valve 13 which is closed by determining whether or not the difference ΔTsens is larger than a predetermine threshold value for the determination. More specifically, the ECU 30 calculates the difference ΔTsens between the engine water temperature thw and the bypass water temperature thb (step S12). Then, the ECU 30 determines whether or not the difference ΔTsens which is calculated at the step S12 is larger than the predetermine threshold value for the determination.

As a result of the determination at the step S13, if it is determined that the difference ΔTsens is not larger than the predetermine threshold value for the determination (step S13: No), the ECU 30 determines that there is not the failure of the switching valve 13 (step S14).

On the other hand, as a result of the determination at the step S13, if it is determined that the difference ΔTsens is larger than the predetermine threshold value for the determination (step S13: Yes), the ECU 30 determines that there is the failure of the switching valve 13 (step S15).

Incidentally, a value which is capable of appropriately determining whether or not there is the failure of the switching valve 13 is preferably used as the threshold value for the determination. This threshold value for the determination may be set in advance by an experiment, a simulation or the like based on the relationship between the "the difference ΔTsens between the engine water temperature thw and the bypass water temperature thb" and the "existence/non-existence of the failure of the switching valve 13".

Moreover, in the above described explanation, the ECU 30 determines whether or not there is the failure of the switching valve 13 on the basis of the difference ΔTsens between the engine water temperature thw and the bypass water temperature thb. However, the ECU 30 may determine whether or not there is the failure of the switching valve 13 on the basis of an integrated value of the difference ΔTsens or a variation amount of the difference ΔTsens per unit time. Namely, the ECU 30 may determine whether or not there is the failure of the switching valve 13 by determining whether or not the integrated value of the difference ΔTsens or the variation amount of the difference ΔTsens per unit time is larger than the predetermined threshold value for the determination. In this case, the ECU 30 may determine that there is the failure of the switching valve 13, if it is determined that the integrated value of the difference ΔTsens or the variation amount of the difference ΔTsens per unit time is larger than the predetermined threshold value for the determination.

(5) Operation of Controlling Electrical WP

As described above, in the present embodiment, the ECU 30 determines whether or not there is the failure of the switching valve 13 by using such a characteristic that the difference ΔTsens between the engine water temperature thw and the bypass water temperature thb is relatively small when there is not the failure of the switching valve 13. In other words, the ECU 30 determines whether or not there is the failure of the switching valve 13 by using such a characteristic that the difference ΔTsens between the engine water temperature thw and the bypass water temperature thb is relatively large when there is the failure of the switching valve 13.

Here, such a characteristic that the difference ΔTsens is relatively small when there is not the failure of the switching valve 13 is caused by such a fact that the cooling water flows from the cooling water pipe 181*c* to the cooling water pipe 181*d* through the switching valve 13 easily when there is not the failure of the switching valve 13. In other words, such a characteristic that the difference ΔTsens is relatively large when there is the failure of the switching valve 13 is caused by such a fact that the cooling water does not flow from the cooling water pipe 181*c* to the cooling water pipe 181*d* through the switching valve 13 easily when there is the failure of the switching valve 13. Thus, if the electrical WP 16 stops during a period when the ECU 30 determines whether or not there is the failure of the switching valve 13, the cooling water does not flow from the cooling water pipe 181*c* to the cooling water pipe 181*d* through the switching valve 13 easily not only when there is the failure of the switching valve 13 but also when there is not the failure of the switching valve 13. Thus, if the electrical WP 16 stops during the period when the ECU 30 determines whether or not there is the failure of the switching valve 13, accuracy of the operation of determining whether or not there is the failure of the switching valve 13 could deteriorate. Therefore, it is preferable that the operation of determining whether or not there is the failure of the switching valve 13 be performed under such a situation that the electrical WP 16 circulates the cooling water in the cooling water pipe 18, in order to maintain the accuracy of the operation of determining whether or not there is the failure of the switching valve 13. Namely, it is preferable that the operation of determining whether or not there is the failure of the switching valve 13 be performed under such a situation that the motor of the electrical WP 16 operates.

On the other hand, in the hybrid vehicle 1, the engine 20 sometimes stops temporarily to improve fuel efficiency or environmental performance. Namely, the supply of fuel to the engine 20 sometimes stops temporarily. When the engine 20 stops, an amount of heat generated by the engine 20 is relatively small. Therefore, there is little need to circulate the cooling water in the cooling water pipe 18 to cool the engine 20, when the engine 20 stops. Therefore, when the engine 20 temporarily stops, it is preferable that the electrical WP 16 also stop to reduce the electrical power consumed by the electrical WP 16.

However, if the electrical WP 16 always stops even when the engine 20 temporarily stops during the period when the ECU 30 determines whether or not there is the failure of the switching valve 13, the accuracy of the operation of determining whether or not there is the failure of the switching valve 13 deteriorates, as described above. Thus, in the present embodiment, although the electrical WP 16 stops as a general rule when the engine 20 stops, the electrical WP 16 does not stop as an exceptional rule when the engine 20 stops during the period when the ECU 30 determines whether or not there is the failure of the switching valve 13.

Hereinafter, with reference to FIG. 8, the operation of controlling the electrical WP 16 to operate in this aspect will be explained. FIG. 8 is a flowchart illustrating a flow of the operation of controlling the electrical WP 16 to operate.

As illustrated in FIG. 8, the ECU 30 calculate a WP driving duty which is a parameter for defining the operational state of the electrical WP 16 on the basis of an output of the engine 20 (step S21). Incidentally, hereinafter, the WP driving duty based on the output of the engine 20 is referred to as a "first WP driving duty".

In addition, the ECU 30 calculates a WP driving duty which is a parameter for defining the operational state of the electrical WP 16 on the basis of heater required heat amount (namely, an amount of the heat which is required for the heater, the defroster, the device and the like, and an amount of the heat which should be recovered by the heater core 12) (step S22). Incidentally, hereinafter, the WP driving duty based on the heater required heat amount is referred to as a "second WP driving duty".

However, the ECU 30 may not calculate the first WP driving duty. Similarly, the ECU 30 may not calculate the second WP driving duty.

Incidentally, the WP driving duty defines a control signal (typically, a PWM (Pulse Width Modulation) signal) which is inputted to the motor of the electrical WP 16. A rotational number of the motor of the electrical WP 16 becomes larger as the WP driving duty becomes larger. Therefore, the flow amount (for example, the flow amount per unit time) of the cooling water which the electrical WP 16 circulates in the cooling water pipe 18 becomes larger as the WP driving duty becomes larger. Moreover, if the WP driving duty is zero, the electrical WP 16 stops. Therefore, if the WP driving duty is zero, the flow amount of the cooling water which the electrical WP 16 circulates in the cooling water pipe 18 is zero (namely, the cooling water remains in the cooling water pipe 18).

Figure 9:
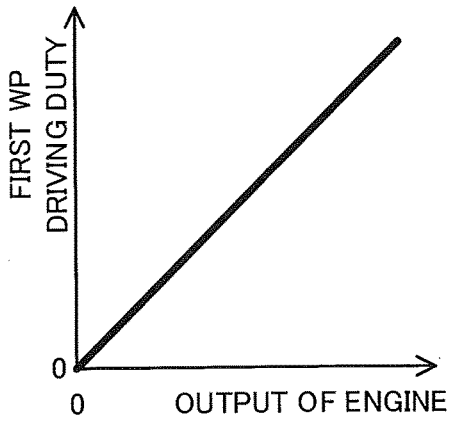
FIG. 9 are graphs illustrating a relationship between the output of the engine and the first WP driving duty and a relationship between the heater required heat amount and the second WP driving duty.
Figure 9:
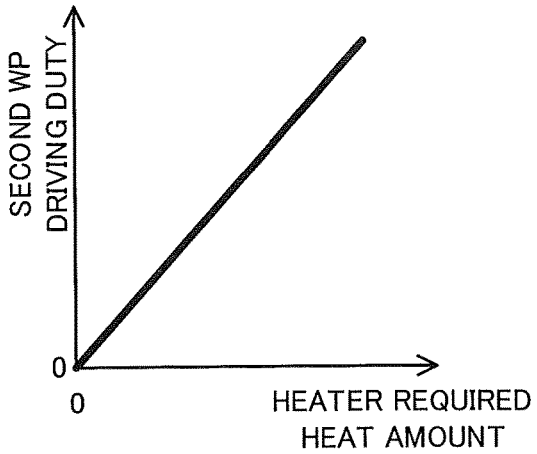

Here, with reference to FIG. 9, the operation of calculating the first and second WP driving duties based on the output of the engine 20 and the heater required heat amount will be explained. FIG. 9 are graphs illustrating a relationship between the output of the engine 20 and the first WP driving duty and a relationship between the heater required heat amount and the second WP driving duty.

As illustrated in FIG. 9(*a*), the ECU 30 may calculate the first WP driving duty such that the first WP driving duty becomes larger as the output of the engine 20 becomes larger. Moreover, the ECU 30 may calculate the first WP driving duty such that the first WP driving duty becomes zero when the output of the engine 20 becomes zero (namely, the engine 20 stops). As a result, the electrical WP 16 stops as a general rule when the engine 20 stops.

As illustrated in FIG. 9(*b*), the ECU 30 may calculate the second WP driving duty such that the second WP driving duty becomes larger as the heater required heat amount becomes larger. Moreover, the ECU 30 may calculate the second WP driving duty such that the second WP driving duty becomes zero when the heater required heat amount becomes zero (namely, the heater, the defroster, the deice and the like are not needed).

Again in FIG. 8, in parallel with the operation at the steps S21 and S22, the ECU 30 calculates the WP driving duty which allows the electrical WP 16 to operate as an exceptional rule when the engine 20 stops during the period when the ECU 30 determines whether or not there is the failure of the switching valve 13 (step S23 to step S27). In other words, the ECU 30 calculates the WP driving duty which allows the electrical WP 16 to operate such that the ECU 30 is capable of determining whether or not there is the failure of the switching valve 13 even when the engine 20 stops (step S23 to step S27). Incidentally, hereinafter, the WP driving duty which allows the electrical WP 16 to operate as an exceptional rule when the engine 20 stops during the period when the ECU 30 determines whether or not there is the failure of the switching valve 13 is referred to as a "third WP driving duty".

Specifically, the ECU 30 determines whether or not the command for opening the switching valve 13 is outputted (step S23).

As a result of the determination at the step S23, if it is determined that the command for opening the switching valve 13 is not outputted (step S23: No), there is little possibility that the ECU 30 is determining whether or not there is the failure of the switching valve 13. This is because the ECU 30 determines whether or not there is the failure of the switching valve 13 after it is determined that the command for opening the switching valve 13 is outputted (see step S11 in FIG. 7). Therefore, the ECU 30 may determine that there is no need to allow the electrical WP 16 to operate as an exceptional rule when the engine 20 stops. Therefore, the ECU 30 does not necessarily calculate the third WP driving duty.

On the other hand, as a result of the determination at the step S23, if it is determined that the command for opening the switching valve 13 is outputted (step S23: Yes), there is a possibility that the ECU 30 is determining whether or not there is the failure of the switching valve 13. Therefore, the ECU 30 determines that there is need to allow the electrical WP 16 to operate as an exceptional rule when the engine 20 stops. Therefore, the ECU 30 continues the operation of calculating the third WP driving duty. Specifically, the ECU 30 determines whether or not the engine 20 temporarily stops (namely, the engine 20 intermittently operates) (step S24).

As a result of the determination at the step S24, if it is determined that the engine 20 does not temporarily stop (step S24: No), there is a high possibility that the electrical WP 16 is not stopping. Namely, there is a high possibility that the electrical WP 16 is operating in accordance with the first WP driving duty which is calculated at the step S21 (alternatively, the second WP driving duty which is calculated at the step S22). Therefore, the ECU 30 does not necessarily calculate the third WP driving duty.

On the other hand, as a result of the determination at the step S24, if it is determined that the engine 20 temporarily stops (step S24: Yes), there is a possibility that the accuracy of the operation of determining whether or not there is the failure of the switching valve 13 deteriorates by the stop of the electrical WP 16 due to the stop of the engine 20 (see FIG. 9(*a*)). Therefore, the ECU 30 determines that there is need to allow the electrical WP 16 to operate as an exceptional rule when the engine 20 stops. Therefore, the ECU 30 continues the operation of calculating the third WP driving duty. Specifically, the ECU 30 determines whether or not the operation of determining whether or not there is the failure of the switching valve 13 is completed (finished) (step S25).

As a result of the determination at the step S25, if it is determined that the operation of determining whether or not there is the failure of the switching valve 13 is completed (step S25: Yes), it is predicted that the electrical WP 16 can stop because the operation of determining whether or not there is the failure of the switching valve 13 is not being performed. Therefore, the ECU 30 resets the third WP driving duty to zero (step S28). As a result, the period during which the electrical WP 16 operates as an exceptional rule in accordance with the third WP driving duty corresponds to a period from the stop of the engine 20 to the completion of the operation of determining whether or not there is the failure of the switching valve 13. Namely, the period during which the electrical WP 16 operates as an exceptional rule in accordance with the third WP driving duty (the period during which the electrical WP 16 operates as an exceptional rule when the engine 20 stops) is limited to the minimum.

On the other hand, as a result of the determination at the step S25, if it is determined that the operation of determining whether or not there is the failure of the switching valve 13 is not completed (step S25: No), it is predicted that the ECU 30 is determining whether or not there is the failure of the switching valve 13. Therefore, the ECU 30 continues the operation of calculating the third WP driving duty. Specifically, the ECU 30 determines whether or not the operation of determining whether or not there is the failure of the switching valve 13 does not start to be performed yet (step S26).

As a result of the determination at the step S26, if it is determined that the operation of determining whether or not there is the failure of the switching valve 13 does not start to be performed yet (step S26: Yes), the ECU 30 newly calculates the third WP driving duty (step S27). In this case, the ECU 30 may calculates, as the third WP driving duty, the minimum duty which is capable of allowing the electrical WP 16 to operate. Moreover, the ECU 30 may calculate (alternatively, adjust) the third WP driving duty on the basis of the speed V of the hybrid vehicle 1 and the SOC value of the battery 500.

Figure 10:
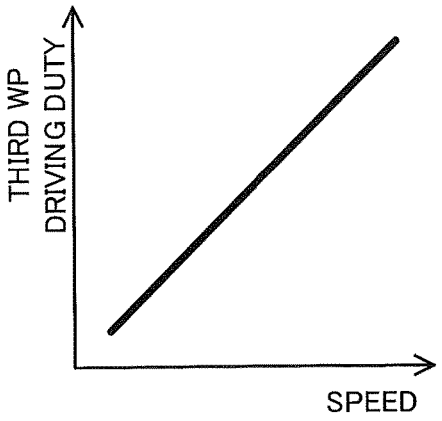
FIG. 10 are graphs illustrating the relationship between the third WP driving duty and each of the speed and the SOC value.
Figure 10:
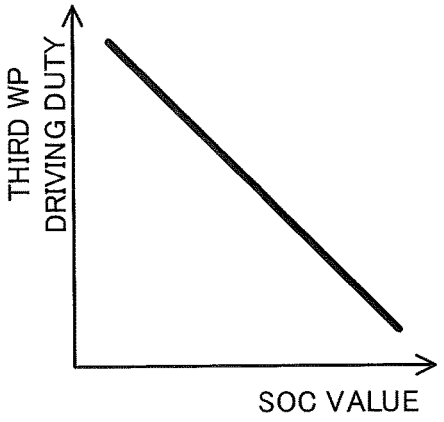

Here, with reference to FIG. 10, the operation of calculating the third WP driving duty on the basis of each of the speed V and the SOC value will be explained. FIG. 10 are graphs illustrating the relationship between the third WP driving duty and each of the speed V and the SOC value.

As illustrated in FIG. 10(*a*), the ECU 30 may calculate the third WP driving duty such that the third WP driving duty becomes larger as the speed V becomes higher. Moreover, the ECU 30 may calculate the third WP driving duty such that the third WP driving duty becomes larger as the SOC value becomes smaller.

Again in FIG. 8, as a result of the determination at the step S26, if it is determined that the operation of determining whether or not there is the failure of the switching valve 13 already starts to be performed (step S26: No), it is predicted that the ECU 30 is determining whether or not there is the failure of the switching valve 13. In this case, it is predicted that the third WP driving duty is already calculated before the operation of determining whether or not there is the failure of the switching valve 13 starts to be performed. Therefore, in this case, the ECU 30 does not necessarily newly calculate the third WP driving duty. However, the ECU 30 may newly calculate (alternatively, adjust) the third WP driving duty.

Then, the ECU 30 allows the electrical WP 16 to operate in accordance with the maximum WP driving duty of the first WP driving duty which is calculated at the step S21, the second WP driving duty which is calculated at the step S22 and the third WP driving duty which is calculated at the step S27 (step S29).

As described above, in the present embodiment, the electrical WP 16 does not stops during the period when the ECU 30 determines whether or not there is the failure of the switching valve 13, even after the engine 20 stops. In other words, the electrical WP 16 operates in accordance with the third WP driving duty during the period when the ECU 30 determines whether or not there is the failure of the switching valve 13, even after the engine 20 stops. Thus, there is little or no possibility that the accuracy of the operation of determining whether or not there is the failure of the switching valve 13 deteriorates due to the stop of the engine 20. Therefore, the ECU 30 is capable of appropriately determining whether or not there is the failure of the switching valve 13.

Incidentally, when the speed V is relatively high, there is a high possibility that the output of the engine 20 is relatively large at a timing before the engine 20 stops, compared to the case where the speed V is relatively low. Therefore, when the speed V is relatively high, there is a high possibility that the engine water temperature thw is relatively high, compared to the case where the speed V is relatively low.

Similarly, when the SOC value is relatively small, it is predicted that the motor generator MG2 (alternatively, the motor generator MG1) does not operate so frequently (in other words, there is small remaining capacity for the motor generator MG2 to operate), compared to the case where the SOC value is relatively large. Thus, when the SOC value is relatively small, there is high possibility that the engine 20 operates frequently, compared to the case where when the SOC value is relatively large. Namely, when the SOC value is relatively small, there is a high possibility that the output of the engine 20 is relatively large at the timing before the engine 20 stops, compared to the case where the SOC value is relatively large. Therefore, when the SOC value is relatively small, there is a high possibility that the engine water temperature thw is relatively high, compared to the case where the SOC value is relatively large.

If the switching valve 13 keeps in the failure state under this situation, a decrease of the engine water temperature thw which is caused by the flow out of the cooling water from the main pipe to the bypass pipe is not facilitated and thus there is a possibility that overheat or the like of the engine 20 arises. Therefore, when the speed V is relatively high, it is preferable that the ECU 30 determine whether or not there is the failure of the switching valve 13 relatively quickly, compared to the case where the speed V is relatively low. Similarly, when the SOC value is relatively small, it is preferable that the ECU 30 determine whether or not there is the failure of the switching valve 13 relatively quickly, compared to the case where the SOC value is relatively large.

On the other hand, the ECU 30 is capable of determining whether or not there is the failure of the switching valve 13 more quickly as the flow amount of the cooling water which is circulated by the electrical WP 16 is larger. The reason is as follows. The cooling water flows from the cooling water pipe 181*c* to the cooling water pipe 181*d* (alternatively, from the main pipe to the bypass pipe) through the switching valve 13 more easily as the flow amount of the cooling water which is circulated by the electrical WP 16 is larger. Therefore, when there is not the failure of the switching valve 13, the difference ΔTsens between the engine water temperature thw and the bypass water temperature thb decreases more rapidly as the flow amount of the cooling water which is circulated by the electrical WP 16 is larger. Namely, a time which is required for the difference ΔTsens to be smaller than the threshold value for the determination in the case where the flow amount of the cooling water which is circulated by the electrical WP 16 is relatively large is shorter than a time which is required for the difference ΔTsens to be smaller than the threshold value for the determination in the case where the flow amount of the cooling water which is circulated by the electrical WP 16 is relatively small. Thus, the ECU 30 is capable of determining whether or not the difference ΔTsens is relatively large (alternatively, larger than the threshold value for the determination) more quickly as the flow amount of the cooling water which is circulated by the electrical WP 16 is larger. Namely, the ECU 30 is capable of determining whether or not there is the failure of the switching valve 13 more quickly as the flow amount of the cooling water which is circulated by the electrical WP 16 is larger.

In the present embodiment, the need for the quick operation of the determination and one method of realizing the quick operation of the determination are considered, and thus the third WP driving duty which defines the operational state of the electrical WP 16 after the engine 20 stops may become larger as the speed V becomes higher as described above. Similarly, as described above, the third WP driving duty which defines the operational state of the electrical WP 16 after the engine 20 stops may become larger as the SOC value becomes smaller. Therefore, the ECU 30 is capable of determining whether or not there is the failure of the switching valve 13 quickly under the situation that it is desired to determine whether or not there is the failure of the switching valve 13 relatively quickly (for example, under the situation that the speed V is relatively high or under the situation that the SOC value is relatively small).

Incidentally, in the above described explanation, the cooling apparatus 10 is mounted on the hybrid vehicle 1. However, the cooling apparatus 10 may be mounted on a vehicle which is not provided with the motor generators MG1 and MG2 and which is provided with the engine 20.

The present invention is not limited to the aforementioned embodiments, but various changes may be made, if desired, without departing from the essence or spirit of the invention which can be read from the claims and the entire specification. A cooling water control apparatus, which involves such changes, is also intended to be within the technical scope of the present invention.

REFERENCE SIGNS LIST

1 vehicle
10 cooling apparatus
11 exhaust heat recovery equipment
12 heater core
13 switching valve
14 radiator
15 thermostat
16 electric WP
17*b*, 17*w* water temperature sensor
18 cooling water pipe
18*a* cooling water pipe
18*b* cooling water pipe
181*a* cooling water pipe
181*b* cooling water pipe
181*c* cooling water pipe
181*d* cooling water pipe
182*a* cooling water pipe

182*b* cooling water pipe
182*c* cooling water pipe
182*d* cooling water pipe
183*a* cooling water pipe
183*b* cooling water pipe
20 engine
30 ECU

The invention claimed is:

1. A cooling water control apparatus for controlling a cooling apparatus, the cooling apparatus being provided with:

(i) a first pipe which circulates a cooling water and which passes through an inside of an engine;

(ii) a second pipe which circulates the cooling water and which does not pass through the inside of the engine;

(iii) a switching valve which is disposed at a downstream side of the engine, a state of the switching valve being changed between an opened state and a closed state in accordance with a command, the opened state allowing a first flow amount of cooling water to flow from the first pipe to the second pipe, the closed state allowing a second flow amount of cooling water to flow from the first pipe to the second pipe, the second flow amount being less than the first flow amount; and (iv) a supplying mechanism which supplies the cooling water to the first and second pipes, the cooling water control apparatus comprising a controller, the controller being programmed to:

determine whether or not there is a failure of the switching valve on the basis of a difference between a first temperature of the cooling water in the first pipe and a second temperature of the cooling water in the second pipe after the command for changing the state of the switching valve from the closed state to the opened state is outputted; and control the supplying mechanism to supply the cooling water even after the engine stops, when the engine stops while the controller is determining whether or not there is the failure of the switching valve, the switching valve being provided with:

(i) a valve portion which opens a passage between the first and second pipes such that the first flow amount of the cooling water flows from the first pipe to the second pipe when the state of the switching valve is the opened state and which closes the passage between the first and second pipes when the state of the switching valve is the closed state; and (ii) a micro flowing portion which allows the second flow amount of the cooling water to flow from the first pipe to the second pipe when the state of the switching valve is the closed state, the controller being programmed to determine whether or not there is a failure of the valve portion.

2. The cooling water control apparatus according to claim 1, wherein the cooling apparatus is mounted on a vehicle which travels by using an output of the engine, the controller is programmed to control the supplying mechanism such that a flow amount of the cooling water which is supplied by the supplying mechanism becomes larger as a speed of the vehicle becomes higher.

3. The cooling water control apparatus according to claim 1, wherein the cooling apparatus is mounted on a hybrid vehicle which travels by using at least one of an output of the engine and an output of a rotating electrical machine which operates by using electrical power stored in a battery, the controller is programmed to control the supplying mechanism such that a flow amount of the cooling water which is supplied by the supplying mechanism, becomes larger as a residual power of the battery becomes smaller.

4. The cooling water control apparatus according to claim 1, wherein

The controller is programmed to control the supplying mechanism to supply the cooling water when a predetermined time does not lapse after the engine stops, and controls the supplying mechanism not to supply the cooling water when the predetermined time lapses after the engine stops.

5. The cooling water control apparatus according to claim 4, wherein the predetermined time is a time which is required for the controller to determine whether or not there is the failure of the switching valve.

* * * * *